US005524898A

United States Patent [19]

Pavlovic

[11] Patent Number: 5,524,898

[45] Date of Patent: Jun. 11, 1996

[54] MATHEMATICAL PUZZLE TYPE GAME

[76] Inventor: Zoran Pavlovic, 7045 S. Woodley Ave., #130, Van Nuys, Calif. 91406

[21] Appl. No.: 359,054

[22] Filed: Dec. 19, 1994

[51] Int. Cl.[6] ..... A63F 1/00; A63F 9/20

[52] U.S. Cl. ..... 273/292; 273/153 R; 273/293; D21/42; D21/104

[58] Field of Search ..... 273/275, 293, 273/292, 153 R, 157 R, 153 S

[56] References Cited

U.S. PATENT DOCUMENTS

| | | | |
|---|---|---|---|
| D. 44,430 | 7/1913 | Wilson | D21/45 |
| 1,450,874 | 4/1923 | Stromee | 273/292 |
| 1,666,448 | 4/1928 | Hardenstein | 273/292 |
| 2,011,163 | 8/1935 | Rothschild | 273/294 |
| 2,024,541 | 12/1935 | Silkman | 273/156 |
| 2,162,876 | 6/1939 | Barton | 273/275 |
| 2,228,180 | 1/1941 | Pauli | 273/293 |
| 2,317,705 | 4/1943 | Wood | 273/292 |
| 2,457,020 | 12/1948 | Whitney | 273/292 |
| 3,482,333 | 12/1969 | Trager, Jr. | 273/293 |
| 4,659,085 | 4/1987 | DeVries | 273/236 |

FOREIGN PATENT DOCUMENTS

| | | | |
|---|---|---|---|
| 2091112 | 7/1982 | United Kingdom | 273/299 |

*Primary Examiner*—Benjamin H. Layno
*Attorney, Agent, or Firm*—Sandra M. Parker

[57] ABSTRACT

A card game which comprises a set of cards of the same size and geometrical configuration, each having a square playing surface. Each of the four sides of each card has a selected visible indicia. The criteria determining how the indicia are to be arranged on the sides of the cards are mathematically selected so as to permit the use of the game as a mathematical puzzle that may be played by one player, played competitively by two players, or for other purposes of entertainment or intellectual stimulation. In many of the games the cards or other playing pieces are arranged in a mutually abutting side-by-side relationship whereby the indicia on each of the sides may match and align with the indicia on respective abutting sides of other cards of the set, and with the top surfaces of the abutting cards forming a square.

40 Claims, 3 Drawing Sheets

LEGEND:

BLUE
RED
BLACK

LEGEND:

BLUE

RED

BLACK

LEGEND:

BLUE

RED

BLACK

MATHEMATICAL PUZZLE TYPE GAME

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

There is always a need for new games that are intellectually stimulating and interesting, and can be played with a minimum of physical inconvenience to the participants. There is a need for multi-player games, and also for games for a single player.

PRIOR ART

Clark U.S. Pat. No. 4,410,180 issued Oct. 18, 1983.

Tzeng U.S. Pat. No. 4,067,580 issued Jan. 10, 1978.

SUMMARY OF THE INVENTION

According to the present invention a single a game set consisting of a deck of cards for various card games, a mathematical puzzle, or a modified form of the well-known Dominos game. The card game comprises a set of cards of the same size and geometrical configuration, each having a square playing surface upon each side of which there is a selected visible indicia. The criteria are mathematically selected so as permit the use of the game as a mathematical puzzle that may be worked on by only a single player, a competitive mathematical puzzle game that is played competitively by several players at the same time, or for other purposes of entertainment or intellectual stimulation. In many of the games the cards or other playing pieces are arranged in a mutually abutting side-by-side relationship whereby the indicia on each of the sides may match and align with the indicia on a side of another card of the set, and with the top surfaces of the cards forming a square. Other games can be played without requiring that specific relationship.

DRAWING SUMMARY

DETAILED DESCRIPTION OF BASIC CARD SET

Figure 1:
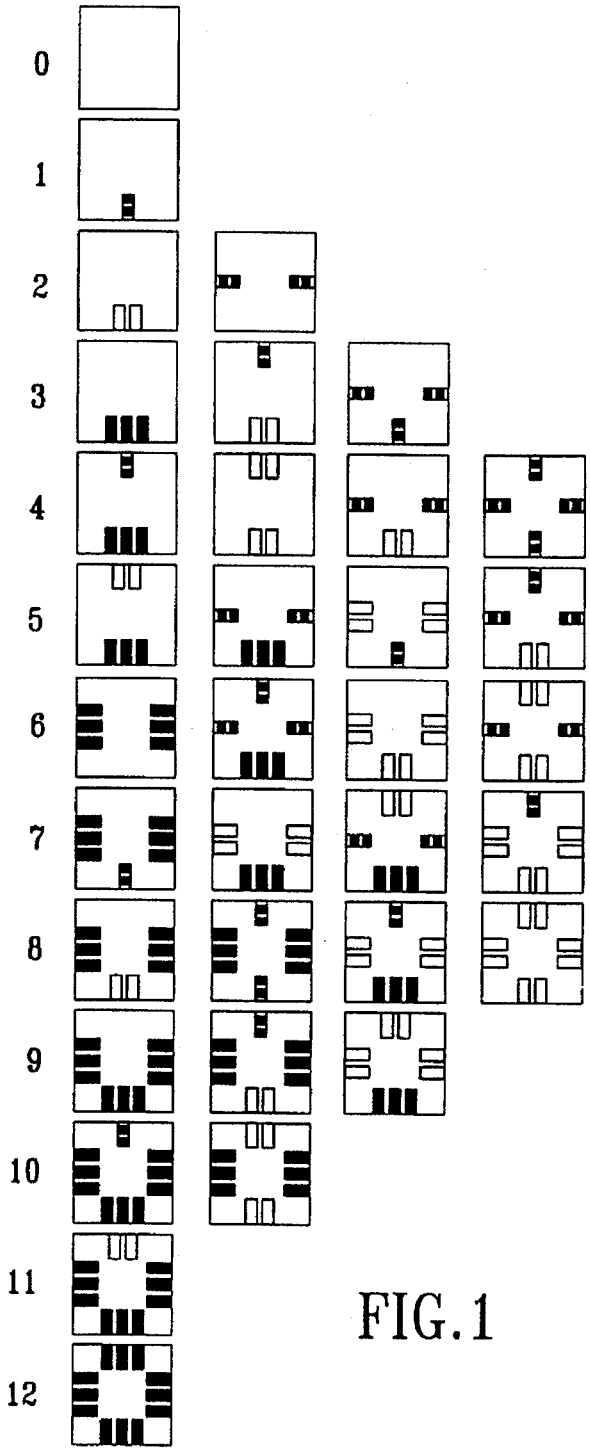
FIG. 1 is a top plan of a basic set of thirty-four cards in accordance with the invention.

Reference is now made to the basic card set shown in FIG. 1. It will be noted that the the cards are arranged in four rows, and the cards in the longest row are numbered from "0" to "12", inclusive. It will also be seen that the "0" card has no visible indicia; that is, its indicia on all four sides is a blank space. The "12" card, however, has three black stripes on each of its four sides, for a total of 12 stripes.

In this basic set of thirty-four cards there are four kinds of indicia that distinguish the various sides of the various cards. One is a blank space, of which there are four on the "0" card. A second indicia is a single blue stripe, such as that which appears in the lateral center of one side of the "1" card. A third indicia is a parallel pair of red stripes such as those that appear in the lateral center of one side of the "2" card. A fourth indicia is the set of three black stripes such as those appearing on all four sides of the "12" card.

Further, the "3" card has only three black stripes on one of its sides; the "4" card has a single blue stripe on one side and three black stripes on the opposite side; the "5" card has two red stripes on one side and three black stripes on the opposite side; the "6" card has three black stripes on each of two opposite sides; the "7" card, in addition to six black stripes like the "6" card, also has a single blue stripe in another side; the "8" card has the same six black stripes plus two red stripes on another side; the "9" card has three black stripes on each of three sides; the "10" card has three black stripes on each of three sides plus a blue stripe on a fourth side; and the "11" side has three black stripes on each of three sides and a pair of red stripes on the fourth side.

In the second row of cards in FIG. 1 there are cards only from "2" to "10", inclusive. The "2" card has two blue stripes on opposite sides of the card; the "3" card has one blue stripe on one side and two parallel red stripes on the opposite side; the "4" card has two pairs of red stripes on opposite sides; the "5" card has two blue stripes on opposite sides, and a set of three black stripes on one of the intermediate sides; the "6" card has a single blue stripe on each of three sides and three parallel black stripes on the fourth side; the "7" card has two pairs of red stripes on opposite sides and a set of three black stripes on one of the intermediate sides; the "8" card has two sets of three parallel black stripes on opposite sides and two blue stripes on the other two opposite sides; the "9" card has two sets of three black stripes on opposite sides, two red stripes on one intermediate side, and one blue stripe on the other intermediate side; and the "10" card has two sets of three black stripes on opposite sides and two pairs of red stripes on the other two opposite sides.

In the third row of cards in FIG. 1 there are cards only from "3" to "9", inclusive. The "3" card has two blue stripes on opposite sides of the card and one blue stripe on an intermediate side; the "4" card has two blue stripes on opposite sides and a pair of red stripes on an intermediate side; the "5" card has two pairs of red stripes on opposite sides, and a single blue stripe on one of the intermediate sides; the "6" card has a pair of red stripes on each of three sides; the "7" card has one blue stripe on each of two opposite sides, a set of three black stripes on one of the intermediate sides, and a pair of red stripes on the other intermediate side; the "8" card has two pairs of red stripes on opposite sides, a blue stripe on one of the intermediate sides, and three black stripes on the other intermediate side; and the "9" card has two red stripes on each of three sides and three black stripes on the fourth side.

In the fourth row of cards in FIG. 1 there are cards only from "4" to "8", inclusive. The "4" card has one blue stripe on each of its four sides; the "5" card has blue stripes on each of three sides and a pair of red stripes on the fourth side; the "6" card has a pair of red stripes on each of two opposite sides and one blue stripe on each of the other two opposite sides; the "7" card has one blue stripe on one side and a pair of red stripes on each of the other three sides; and the "8" card has a pair of red stripes on each of the four sides.

It will therefore be seen that, by counting a blank space as a numerical "0", the "0" card has a total count of "0"; whereas by counting each stripe as "1" each of the other cards has a total count equal to its number. For example, the "8" card in each of the four rows has a total count of eight, but there is a different set of indicia in each row to accomplish that result.

It will be seen that in the basic card set of FIG. 1 each card is symmetrical about a central dividing line. That is, if a dividing line were drawn vertically through the center of each card, that portion of the card on the right side of the dividing line will be a mirror image of that portion of the card remaining on the left side of the dividing line.

USE OF THE BASIC CARD SET

The usefulness and versatility of the basic card set can be seen, for example, in the game that I call K-9. For convenience I refer to each of the cards as a "Zoki", since some other equivalent kind of device may be used in lieu of the cards as shown. In the game of K-9 it is desirable to remove the "0" and "12" cards, the "4" card in row four that has four separate blue stripes, and the "8" card in row four that has four pairs of red stripes. This then leaves a playing deck of thirty cards.

Figure 2A:
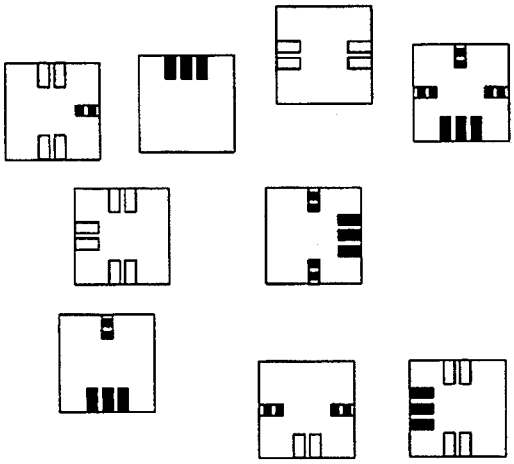
FIG. 2A illustrates a random selection of nine of the cards of the basic set of FIG. 1.
Figure 2B:
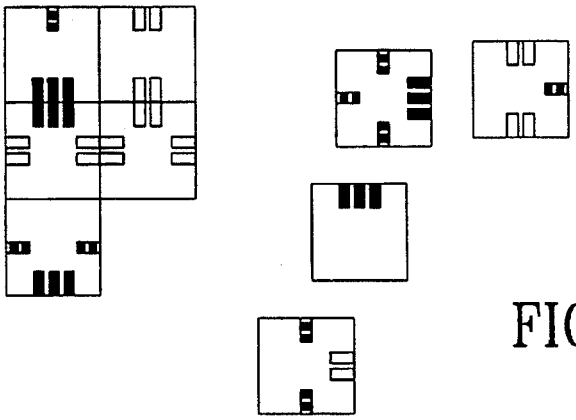
FIG. 2B illustrates a partial re-arrangement of the nine cards of FIG. 2A in order to bring them into a matching side-by-side relationship.

The K-9 game is then played by dealing, at random, nine cards or Zokis to each player. There may be one, two, or three players. The object for each player is to arrange his or her nine cards into a three-by-three square in which all of the abutting pairs of sides of the cards have matching and aligned indicia. This will be more clear by reference to FIGS. 2A, 2B, and 2C. As shown in FIG. 2A the nine cards are laid out in a generally square configuration, but there are no abutting sides that match. Then in FIG. 2B it can be seen how certain ones of the same cards have been rearranged into abutting relationship in which the adjacent sides are matching. It should be noted that to accomplish that result certain cards have to be moved from their original location to a different location, and also rotated by one or more quarter turns, in order to achieve the desired result.

Figure 2C:
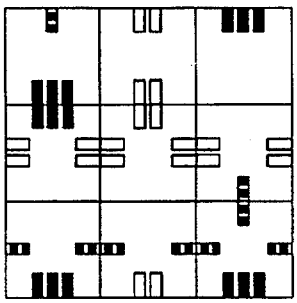
FIG. 2C illustrates the same nine cards when arranged in a three-by-three square with all of the abutting edges having matching and aligned indicia.

FIG. 2C shows the same group of nine cards when the matching and alignment process has been completed. Each side of each card or Zoki that is inside the square is in abutting relationship with a side of another card, and the indicia on the two abutting sides not only match, in number and color, but are also aligned.

In the three-by-three square configuration of nine cards or Zokis there are at least four million possible combinations. By far the greatest number of these will work to achieve the matching and aligned relationship of indicia as shown in FIG. 2C. There are a few combinations, however, where a match is not possible. For example, if one of the indicia appears only in a double form on opposite sides of the same card, a match is not possible.

To reduce the likelihood of having a group of nine cards that cannot be matched, it is desirable to remove three additional cards from the basic set, reducing the number to twenty-seven. The cards to be removed should be the "6" card of row four having two pairs of red stripes and two single blue stripes; the "8" card from row two having two sets of three black stripes and two single blue stripes; and the "10" card in row two having two sets of three black stripes and two pairs of red stripes. With those three cards removed the likelihood of running into an impasse is greatly reduced. Furthermore, if there are three players, the remaining twenty-seven cards can be evenly divided among those three players.

It would also be possible to further reduce the likelihood of an impasse by removing three more cards, the "2" card in row two, having two blue stripes on opposite sides of the card, the "4" card in row two having two pairs of red stripes on opposing sides, and the "6" card in row one having three black stripes on opposing sides.

FOUR-BY-FOUR SQUARES WITH THE BASIC CARD SET

The basic card set may also be used by dealing out sixteen cards at random. There are more than two billion possible combinations of any sixteen cards. This group of cards can then be arranged into a four-by-four square, with matching and alignment of indicia on the abutting sides of the cards. There are a few of the possible combinations which can not be made to work in this way, but I have played several thousand of the sixteen-card groups and have not yet run into an impasse in forming the desired four-by-four square.

YUGO

Another game that can be played with the basic card set I have named YUGO. To start any game, the Zokis are placed face down on the table and are shuffled by being moved about at random. Two, three, four or more persons may play the game, each player for himself. Four individuals can play in two partnerships.

The object of play is to score points during the game as much as possible. The Zokis of the basic card set are first placed face down and shuffled. Each player takes five Zokis from the pile for his hand. For the first play a Zoki is laid face up on the table, from the pile. The layout is open in all four directions, all open ends, or ends which are not abutting against another Zoki are countable. During play the existing layout is maintained and expanded, and points are counted on each play. To make points, all sides are added. For example: If the first laid down Zoki is five or ten, then the dealer received the points.

A Zoki from a player's hand is laid down with one of its sides to be matched against one of the sides of a Zoki already down. Total of the open ends is added and if the total is a multiple of five, then points are made. Now there are two Zokis on the table and play is open on six ways.

For example: If the dealer turns over a five card having three black stripes and two blue stripes, he scores five. When the second player places a "7" card that has three double red stripes and one blue stripe, with blue stripes of the two cards matched, then the outside edges of the two cards add up to ten, and the player has then scored ten. When player has no playable Zoki he loses his turn and a Zoki from his hand is put off to the player's side. Each player in turn plays one Zoki until no Zokis remain in any player's hand. After all Zokis have been played or set aside, players who had to set aside Zokis total up the value of their set aside Zokis and the other players receive that value, rounded off to the closest multiple of five. For example, seven count as five and eight as ten. The Zokis are then reshuffled and play continues in the above-mentioned procedure until one player reaches a certain point total which had been agreed to prior to the start of play.

Players can agree to the desired point total for determining a winner. In two-hand, the first to reach two hundred points wins a game.

DESCRIPTION OF EXPANDED CARD SET

Figure 3:
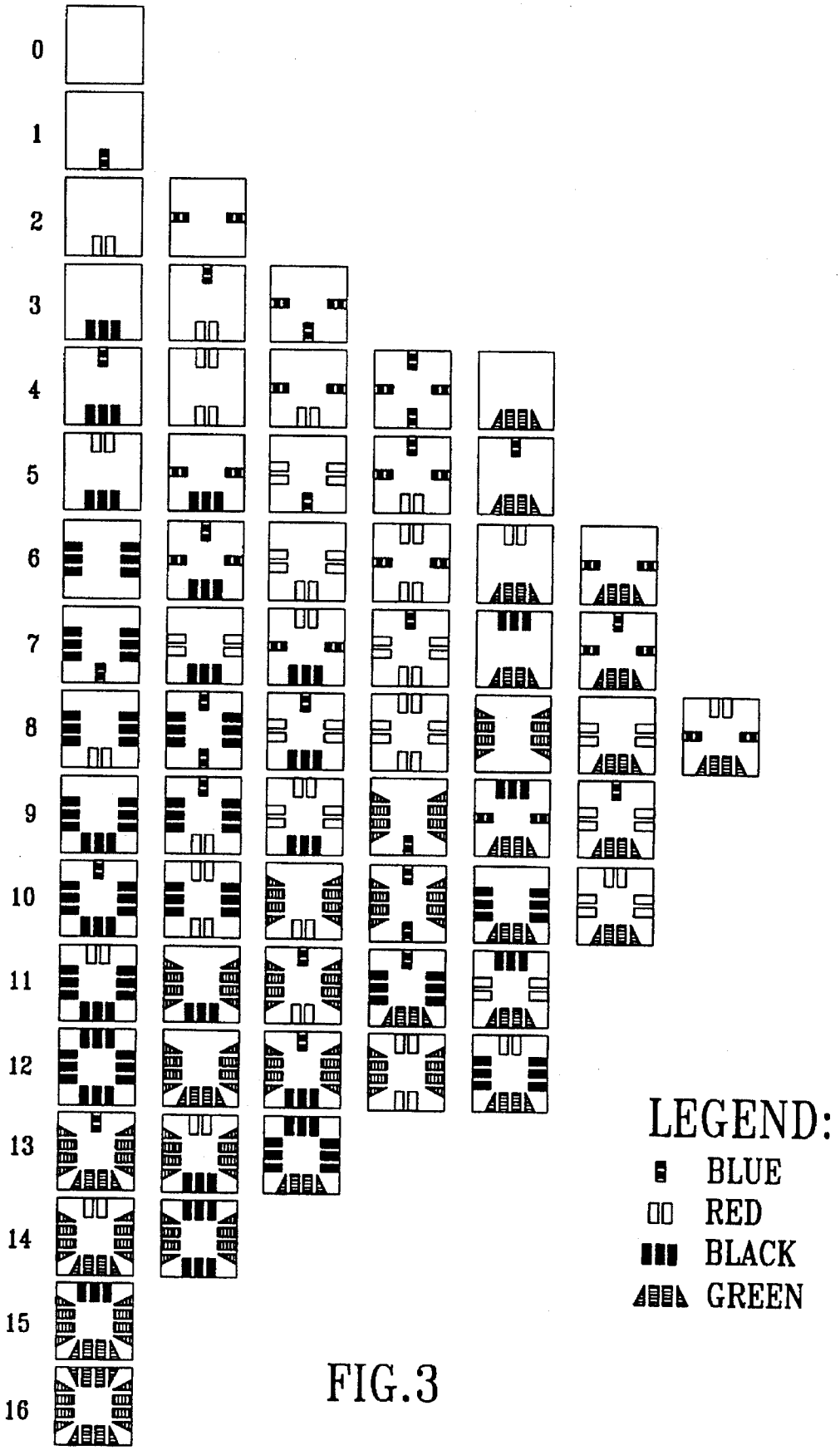
FIG. 3 illustrates an expanded set of sixty-five cards in accordance with the invention.

Reference is now made to FIG. 3 illustrating the expanded card set in accordance with the invention. It will be seen that all of the thirty-four cards of the basic set are still used. In addition, a fifth type of indicia is used so as to identify a larger number of cards. The fifth indicia as shown in the present illustration consists of four green marks placed in a generally parallel relation on one side of the card. As presently shown only the two inner marks could be called "stripes" while the two outer marks have corners cut off and are actually triangles. It will be understood, however, that the exact nature and shape of the indicia that are used would not be critical to the invention, and that the invention can be carried out using modified forms of such indicia.

In the expanded card set of FIG. 3 there are sixty-five cards, and there are five different types of indicia each of which appears a total of fifty-two times. Each of the indicia appears at least once on thirty-one of the cards; and each indicia appears only once on sixteen cards, only twice on ten cards, only three times on four cards, and on all four sides of only one card.

UNSYMMETRICAL CARDS

The concept of the present invention can be extended to create cards that are unsymmetrical; for example, a single blue stripe on one side of the card and another one on an adjacent side, so that the two stripes are at an angle of ninety degrees to each other. Or for another example, three black stripes can be placed on one side of a card and two red stripes on an adjacent side at an angle of ninety degrees to the black stripes. Constructing the cards in that way greatly increases the number of card configurations that are possible, since there may be an unsymmetrical left version and an unsymmetrical right version of the same card. The symmetrical card designs as shown in the drawings represent the presently preferred way of carrying out the invention.

Thus, according to the invention, the basic set of thirty-four symmetrical cards and the expanded set of sixty-five symmetrical cards are presently preferred. In the symmetrical arrangement each indicia other than blank is laterally centered on the associated side of the card so as to facilitate alignment of that indicia when two cards are placed in abutting edge-to-edge relationship. And if only two indicia other than blank are used on a card, they are on opposite sides, not adjacent sides, and are symmetrical relative to a center line running between the the opposite sides.

OTHER CARD CONFIGURATIONS

The principles of the present invention can be applied to other card forms, such as triangular. From using the triangular card forms I have found that the possibilities are much more limited. Also, mechanical handling of triangular cards is less convenient than for the square cards. Other configurations may also be used, such as pentagon or sextagon.

In some applications of my square cards it is not feasible to use paper or cardboard, particularly if the rules of the game are similar to those of the well-known Dominos game. In that instance I prefer to make playing pieces of rigid tile members.

USE WITH DICE

Another use of my cards is to put them onto a set of six dice. Each individual dice has six faces, making a total of thirty-six faces for the set. I prefer to omit the "0" card, and use three cards designated as Jokers in any suitable manner. The three Jokers should be put onto three separate dice, and the remaining thirty-three faces are covered with the other thirty-three cards of the basic set, either selected at random, or in some particular desired arrangement.

COMPUTERIZED EMBODIMENT

While the invention is presently illustrated in the form of tangible and visible cards, the mathematical principles and concepts can be easily incorporated into a computer program. The computer can then be used to reject card combinations that would not be workable in the particular game context that was planned.

What I claim is:

1. A card game comprising a maximum of thirty cards, each of square configuration, each card having a playing surface with a selected indicia on each side thereof, there being a total of four different types of such indicia; said game being characterized in that no card has the same indicia appearing on all four sides thereof, and on all the cards at least two such indicia appear on respectively different sides thereof; whereby almost any nine of said cards selected at random may be formed into a three-by-three square with each pair of abutting edges having matching indicia.

2. A card game as in claim 1 wherein each such indicia is laterally centered on the associated side of the card so as to facilitate alignment of the indicia whenever two cards are placed in abutting edge-to-edge relationship.

3. A card game as in claim 2 wherein on each card upon which a particular indicia appears only twice, that indicia is on opposite sides of the card.

4. A card game as in claim 2 wherein each of said indicia has a different numerical significance.

5. A card game as in claim 1 wherein on each card upon which a particular indicia appears only twice, that indicia is on opposite sides of the card.

6. A card game as in claim 5 wherein each of said indicia has a different numerical significance.

7. A card game as in claim 1 wherein a first one of said indicia is a blank, a second one of said indicia is a stripe of a first color, a third one of said indicia is a pair of stripes of a second color, and the fourth of said indicia is three stripes of a third color; each such indicia being laterally centered on the associated side of the card so as to facilitate alignment of the indicia when two cards are placed in abutting edge-to-edge relationship.

8. A card game as in claim 1 which includes only twenty-seven cards; wherein only three cards have one pair of identical indicia on two opposite sides in addition to another pair of identical indicia on the other two opposite sides.

9. A card game as in claim 8 wherein each such indicia is laterally centered on the associated side of the card so as to facilitate alignment of the indicia whenever two cards are placed in abutting edge-to-edge relationship.

10. A card game as in claim 9 wherein on each card upon which a particular indicia appears only twice, that indicia is on opposite sides of the card.

11. A card game as in claim 9 wherein each of said indicia has a different numerical significance.

12. A card game as in claim 8 wherein on each card upon which a particular indicia appears only twice, that indicia is on opposite sides of the card.

13. A card game as in claim 12 wherein each of said indicia has a different numerical significance.

14. A card game as in claim 8 wherein each of said indicia has a different numerical significance.

15. A card game as in claim 8 wherein each such indicia is laterally centered on the associated side of the card so as to facilitate alignment of the indicia whenever two cards are placed in abutting edge-to-edge relationship; wherein on each card upon which a particular indicia appears only twice, that indicia is on opposite sides of the card; and wherein each of said indicia has a different numerical significance.

16. A card game as in claim 1 which includes only twenty-four cards; wherein no card has one pair of identical indicia on two opposite sides in addition to another pair of identical indicia on the other two opposite sides.

17. A card game as in claim 16 wherein each such indicia is laterally centered on the associated side of the card so as to facilitate alignment of the indicia whenever two cards are placed in abutting edge-to-edge relationship.

18. A card game as in claim 17 wherein on each card upon which a particular indicia appears only twice, that indicia is on opposite sides of the card.

19. A card game as in claim 17 wherein each of said indicia has a different numerical significance.

20. A card game as in claim 16 wherein on each card upon which a particular indicia appears only twice, that indicia is on opposite sides of the card.

21. A card game as in claim 20 wherein each of said indicia has a different numerical significance.

22. A card game as in claim 16 wherein each of said indicia has a different numerical significance.

23. A card game as in claim 16 wherein each such indicia is laterally centered on the associated side of the card so as to facilitate alignment of the indicia whenever two cards are placed in abutting edge-to-edge relationship; wherein on each card upon which a particular indicia appears only twice, that indicia is on opposite sides of the card; and wherein each of said indicia has a different numerical significance.

24. A card game as in claim 1 wherein each such indicia is laterally centered on the associated side of the card so as to facilitate alignment of the indicia whenever two cards are placed in abutting edge-to-edge relationship; wherein on each card upon which a particular indicia appears only twice, that indicia is on opposite sides of the card; and wherein each of said indicia has a different numerical significance.

25. A card game comprising thirty-four cards, each of square configuration, each card having a playing surface upon which each side is characterized by a selected indicia, there being a total of four different types of such indicia; said game being further characterized in that: each type of such indicia appears a total of thirty-four times; each said indicia appears on all four sides of only one card; on all the other cards at least two such indicia appear on respective sides thereof; and each of said indicia appears at least once on nineteen of said cards, only once on nine cards, only twice on six cards, and only three times on three cards.

26. A card game as in claim 25 wherein each such indicia is laterally centered on the associated side of the card so as to facilitate alignment of the indicia whenever two cards are placed in abutting edge-to-edge relationship.

27. A card game as in claim 26 wherein for each card upon which each said indicia appears only twice, it is on opposite sides of the card.

28. A card game as in claim 26 wherein each of said indicia has a different numerical significance.

29. A card game as in claim 25 wherein for each card upon which each said indicia appears only twice, it is on opposite sides of the card.

30. A card game as in claim 29 wherein each of said indicia has a different numerical significance.

31. A card game as in claim 25 wherein a first one of said indicia is a blank, a second one of said indicia is a single stripe, a third one of said indicia is a pair of stripes, and the fourth of said indicia is three stripes.

32. A card game as in claim 25 wherein each such indicia is laterally centered on the associated side of the card so as to facilitate alignment of the indicia whenever two cards are placed in abutting edge-to-edge relationship; wherein on each card upon which a particular indicia appears only twice, that indicia is on opposite sides of the card; and wherein each of said indicia has a different numerical significance.

33. A card game comprising sixty-five cards, each of square configuration, each card having a playing surface upon which each side is characterized by a selected indicia, there being a total of five different types of indicia each of which appears a total number of fifty-two times; said game being further characterized in that: each of said indicia appears at least once on thirty-one of said cards; each said indicia appears on all four sides of only one card, and on all the other cards at least two such indicia appear on respective sides thereof; and each such indicia appears only once on sixteen cards, only twice on ten cards, and only three times on four cards.

34. A card game as in claim 33 wherein a first one of said indicia is a blank, a second one of said indicia is a single stripe, a third one of said indicia is a pair of stripes, the fourth of said indicia is three stripes, and the fifth of said indicia is four marks.

35. A card game as in claim 33 wherein each such indicia is laterally centered on the associated side of the card so as to facilitate alignment of the indicia whenever two cards are placed in abutting edge-to-edge relationship.

36. A card game as in claim 35 wherein for each card upon which each said indicia appears only twice, it is on opposite sides of the card.

37. A card game as in claim 35 wherein each of said indicia has a different numerical significance.

38. A card game as in claim 33 wherein for each card upon which each said indicia appears only twice, it is on opposite sides of the card.

39. A card game as in claim 38 wherein each of said indicia has a different numerical significance.

40. A card game as in claim 33 wherein each such indicia is laterally centered on the associated side of the card so as to facilitate alignment of the indicia whenever two cards are placed in abutting edge-to-edge relationship; wherein on each card upon which a particular indicia appears only twice, that indicia is on opposite sides of the card; and wherein each of said indicia has a different numerical significance.

* * * * *